US011873145B2

(12) United States Patent
Brown

(10) Patent No.: US 11,873,145 B2
(45) Date of Patent: Jan. 16, 2024

(54) BOX FASTENING SYSTEM

(71) Applicant: Armin Brown, Cypress, CA (US)

(72) Inventor: Armin Brown, Cypress, CA (US)

(73) Assignee: Armin Brown, Cypress, CA (US)

( * ) Notice: Subject to any disclaimer, the term of this patent is extended or adjusted under 35 U.S.C. 154(b) by 0 days.

(21) Appl. No.: 17/229,839

(22) Filed: Apr. 13, 2021

(65) Prior Publication Data

US 2022/0324609 A1 Oct. 13, 2022

(51) Int. Cl.
*B65D 5/66* (2006.01)

(52) U.S. Cl.
CPC ..... *B65D 5/6611* (2013.01)

(58) Field of Classification Search
CPC .... B65D 45/00; B65D 5/4283; B65D 5/6673; B65D 5/6647; B65D 5/643; B65D 5/6611; B65B 51/04
USPC .... 229/125.39, 125.41, 117.24, 125, 125.21, 229/125.23, 125.02, 125.38; 292/288; 53/416; 24/563; 220/324, 770
See application file for complete search history.

(56) References Cited

U.S. PATENT DOCUMENTS 1,432,808 A * 10/1922 Thiemann ..... B65D 63/14 229/125.38
1,473,942 A * 11/1923 Strauss ..... B65D 5/68 229/125.22
1,476,520 A * 12/1923 Kaye ..... B65D 63/14 229/125.38
1,497,898 A * 6/1924 Fellowes ..... B65D 5/6647 229/126
1,531,167 A * 3/1925 Yerger ..... B60P 7/083 229/125.38
1,574,737 A * 2/1926 Fellowes ..... B65D 5/643 229/126
1,756,356 A * 4/1930 Hill ..... B65D 5/6611 24/127
2,104,828 A * 1/1938 Brinnon ..... B65D 5/6611 229/122
2,339,691 A * 1/1944 Fellowes ..... B42F 17/02 229/125.38
4,768,704 A * 9/1988 Beckway ..... B65D 5/6673 24/297
7,284,688 B1 * 10/2007 Barsness ..... B65D 5/643 229/125.39
2020/0384658 A1 * 12/2020 Koizumi ..... B65D 5/643

* cited by examiner

*Primary Examiner* — Christopher R Demeree
(74) *Attorney, Agent, or Firm* — James Scott Nolan

(57) ABSTRACT

A fastening kit for one or more flaps of a used container, where the used container has an opening that is enclosable by the one or more flaps. The fastening kit includes at least two buttons, each being configured for securement to a top surface of each of the one or more flaps of the used container. The fastening kit further includes an attachment mechanism for securing each button to the top surface of each of the one or more flaps of the used container. The fastening kit further includes a string adapted to be wound under and around the button after securement to the top surface of one of the one or more flaps, and configured to be secured to a second button secured to another one of the one or more flaps.

4 Claims, 6 Drawing Sheets

ATTACHING BUTTON ASSEMBLIES TO A BOX:

ATTACHING STRING TO BUTTON:
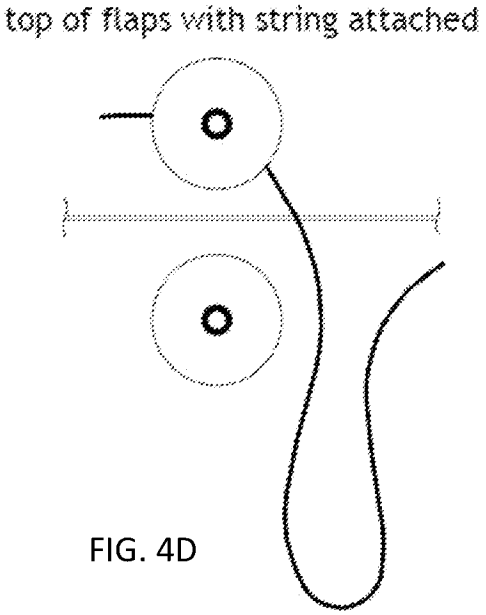
FIG. 4D
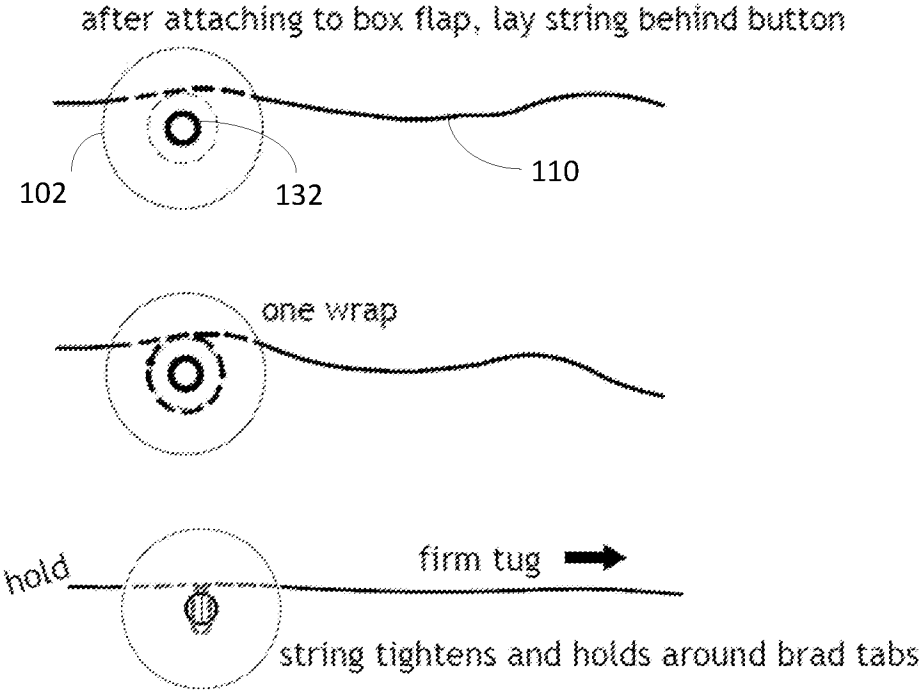
FIG. 4A
FIG. 4B
FIG. 4C

EXAMPLES OF PRODUCT ENGAGED WITH BOX:

BOX FASTENING SYSTEM

BACKGROUND

This application relates to a fastening system, and more particularly to a system that can be attached to a container that has been previously used to deliver a product, in order to provide additional containing functionality to the container.

In the modern age, many product purchases are made remotely, either online through the Internet or telephonically. Such purchases that are not made on site at a "brick and mortar" physical store are typically packaged and delivered within a container by a delivery service. These containers are almost exclusively formed of a fibrous material, such as corrugated fiberboard or cardboard, and most often formed as a six-sided box with at least two flaps that are used to open and close the box. These containers include at least one side or end that provides an opening in which to receive the product. Upon receipt of the product, the opening is closed by at least one flap or other member that extends from the container. For instance, many containers are formed as a box, such as a cube or hexahedron having six sides, where at least one side (typically the top side) provides an opening in which to receive the product, and comprises a set of two or more flaps to close the opening to thereby enclose the product entirely within the box.

Once closed, and prior to transportation and delivery, the container is sealed, which is overwhelmingly done by adhesive tape that is applied over a seam between two flaps, or between a flap and a side or surface of the container. But, once delivered, unsealed and opened, it is often difficult to close and reseal the container. For instance, tape that is used to seal a box is often cut with a knife or scissors, or simply pulled away from the box which can pull away some portion of cardboard on the flaps that enclose the opening, rendering the box unable to be resealed with the original tape or even new tape.

Sometimes a box with a four-flap opening can be kept and reused by interlacing the four flaps with each other. However, this technique mangles the flaps, as at least one of the flaps needs to be folded in order to interlace it with another flap. Further, such interlacing exposes at least one corner of each flap to catching and further structural damage, and over time the box is rendered ineffectual and useless.

Accordingly, most containers are simply thrown away or otherwise discarded after their first and only use, contributing to an increase in waste and damaging the environment.

Some containers, such as envelopes or file pockets, are pre-formed with a button-and-string fastener, which consists of a first button attached to a flap of the envelope or pocket, and a second button attached to a body portion of the envelope or pocket. A string that is permanently attached to one of the buttons can be used to wrap around with tension underneath the other button to bind the two buttons with the tension, and thereby securing the flap with the body portion. However, implementing such a closure system for an envelope or pocket is done during the manufacturing process, and which would be infeasible for a larger container such as a cardboard box.

Accordingly, what is needed is a post-consumer kit, system, or mechanism by which containers can be effectively reused, by being able to be closed and sealed without the aforementioned problems and limitations.

SUMMARY

This document presents an enclosure fastening system, in the form of a kit, system and/or mechanism, for retrofitting containers, such as a cardboard box, to enable a used container to be reused instead of discarded after its first use.

In some aspects, the enclosure fastening system includes a fastening kit for one or more flaps of a used container, where the used container has an opening that is enclosable by the one or more flaps. The fastening kit includes at least two buttons, each being configured for securement to a top surface of each of the one or more flaps of the used container. The fastening kit further includes an attachment mechanism for securing each button to the top surface of each of the one or more flaps of the used container. The fastening kit further includes a string adapted to be wound under and around the button after securement to the top surface of one of the one or more flaps, and configured to be secured to a second button secured to another one of the one or more flaps.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

FIGS. 4A-4D illustrates a method of attaching a string to one button of a button assembly;

Like reference symbols in the various drawings indicate like elements.

DETAILED DESCRIPTION

This document describes a fastening system, kit, and components thereof, for fastening one or more flaps that define an opening of a container, such as a cardboard box or the like, to secure closure of the opening of the container.

Figure 1:
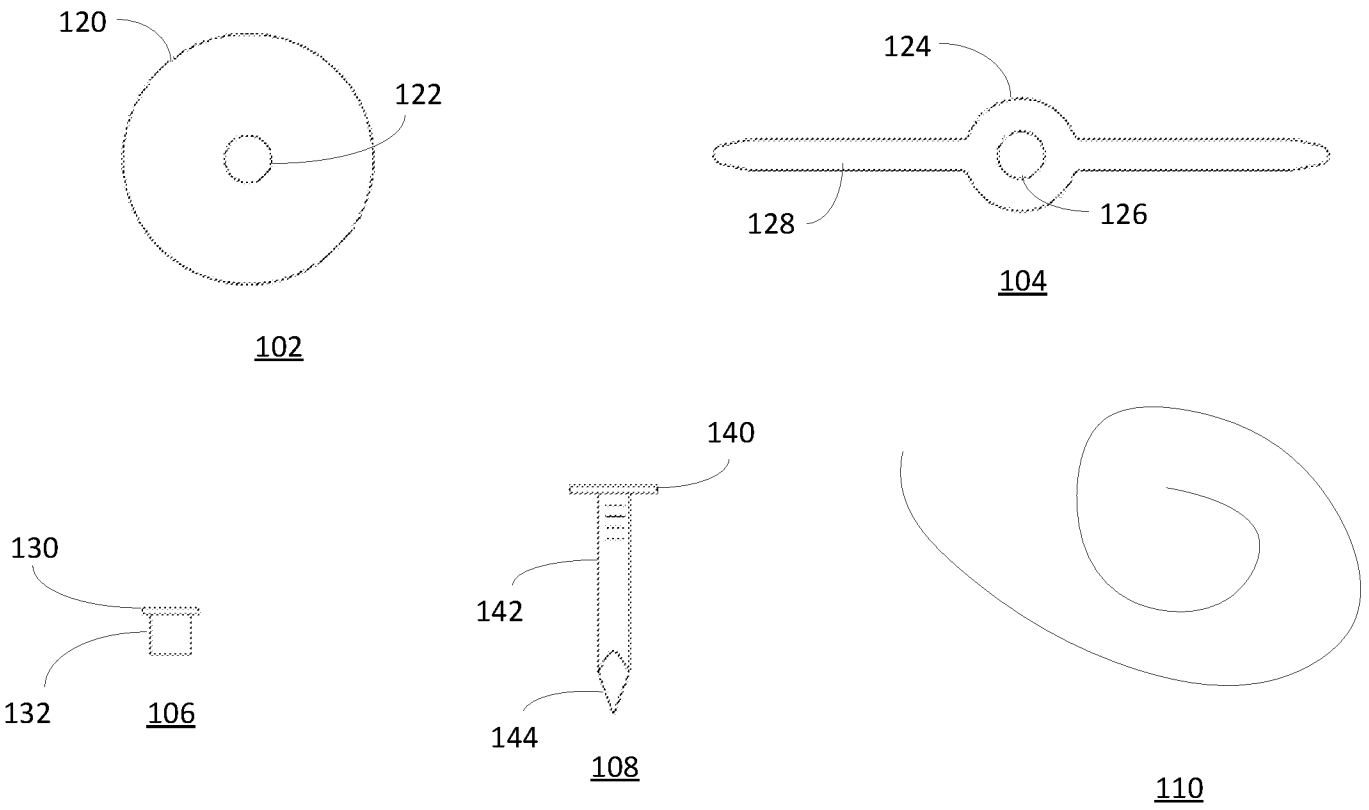
FIG. 1 shows components of an enclosure fastening system.

FIG. 1 shows components of an enclosure fastening system 100, which includes a button 102, a brad 104, and a rivet 106. The system 100 can also include a nail 108 or similar puncturing member, and a string 110 or a thread, twine, strand, rope, cable, yarn, or the like. In some preferred exemplary implementations, the system 100 includes at least two buttons 102 formed of a fiber material such as pressed paper, at least two brads 104 formed of metal or other rigid material, and at least two rivets 106 formed of metal or other rigid, yet deformable, material.

In some implementations, the buttons 102 of the system 100 have an outer periphery 120 with a diameter of between 12-50 mm. Each button 102 includes a central aperture or hole 122 that is preferably 2-6 mm in diameter. Preferably, the outer periphery 120 of each button 102 and its central aperture or hole 122 is circular in shape, but can be other shapes as well, such as squared, rectangular, triangular, and the like. As stated above, the button 102 can be formed of a fiber material or other semi-rigid, friction-forming material, and can have a thickness of between 0.5-2 mm so as to be able to be flexed slightly upward to receive string 110 thereunder, but have enough resiliency and torque so as to securely wedge the string underneath.

The brad 104 includes a ring 124 that includes a central aperture 126. The ring 124 has a diameter of between 10-25 mm, while the central aperture 126 preferably has an inner diameter of between 2-6 mm. Each brad 104 includes two tabs 128 that preferably extend laterally from opposing sides of the ring 124. End-to-end, the tabs 128 are 40-160 mm in length, and therefore approximately 7.5-75 mm long each. The tabs 128, as well as the ring 124, can have a thickness of between 0.2-1 mm, such that the tabs 128 can be bent, pinched or crimped to a desired state, as will be explained in further detail below. The tabs 128 need not be identical in length, and can be of different lengths to allow the longer tab 128 to first thread the central aperture or hole 122 of the button as well as any hole formed by piercing by the nail 108, thereby making it easier to have the other, shorter tab 128 follow the longer tab 128 through such holes.

In some implementations, the rivet 106 used in the system 100 includes a head 130 and a pin 132. The head 130 has a diameter of between 8-20 mm, or of a diameter sufficient to abut the top of the button 102 as the pin 132 is threaded through the central aperture or hole 122 of the button 102 and the central aperture 126 of the brad 104. The head 130 can be 0.5-2 mm thick, so as to provide sufficient rigidity. The pin 132 is preferably cylindrical, but can be other shapes, and has a diameter of between 3-6 mm and a height of between 3-6 mm. The pin 132, and the rivet 106 in general, are made of a pliable metal or similar material so that the pin 132 can be flared, rolled, crimped, compressed, hammered or otherwise expanded to lock the rivet 106 in place as threaded through the central aperture or hole 122 of the button 102 and the central aperture 126 of the brad 104.

The nail 108 includes a head 140, a shank 142, and a point 144. The head 140 is preferably 8-20 mm wide, so as to accommodate a user's thumb or other finger when pushing the nail 108 through a flap or other surface of the container to create a hole for the tabs 128 of the brad 104, as explained further below. The shank 142 preferably has a diameter of between 2-4 mm, and the shank 142 with the point 144 preferably has a length of between 12-25 mm, or sufficient to penetrate and bore through the desired surface of the container. Finally, the string 110 is any threaded, woven or twisted material formed in a diameter of between 0.8-2 mm, and can be provided in a kit or system at lengths of between 200-500 mm.

Figure 2:
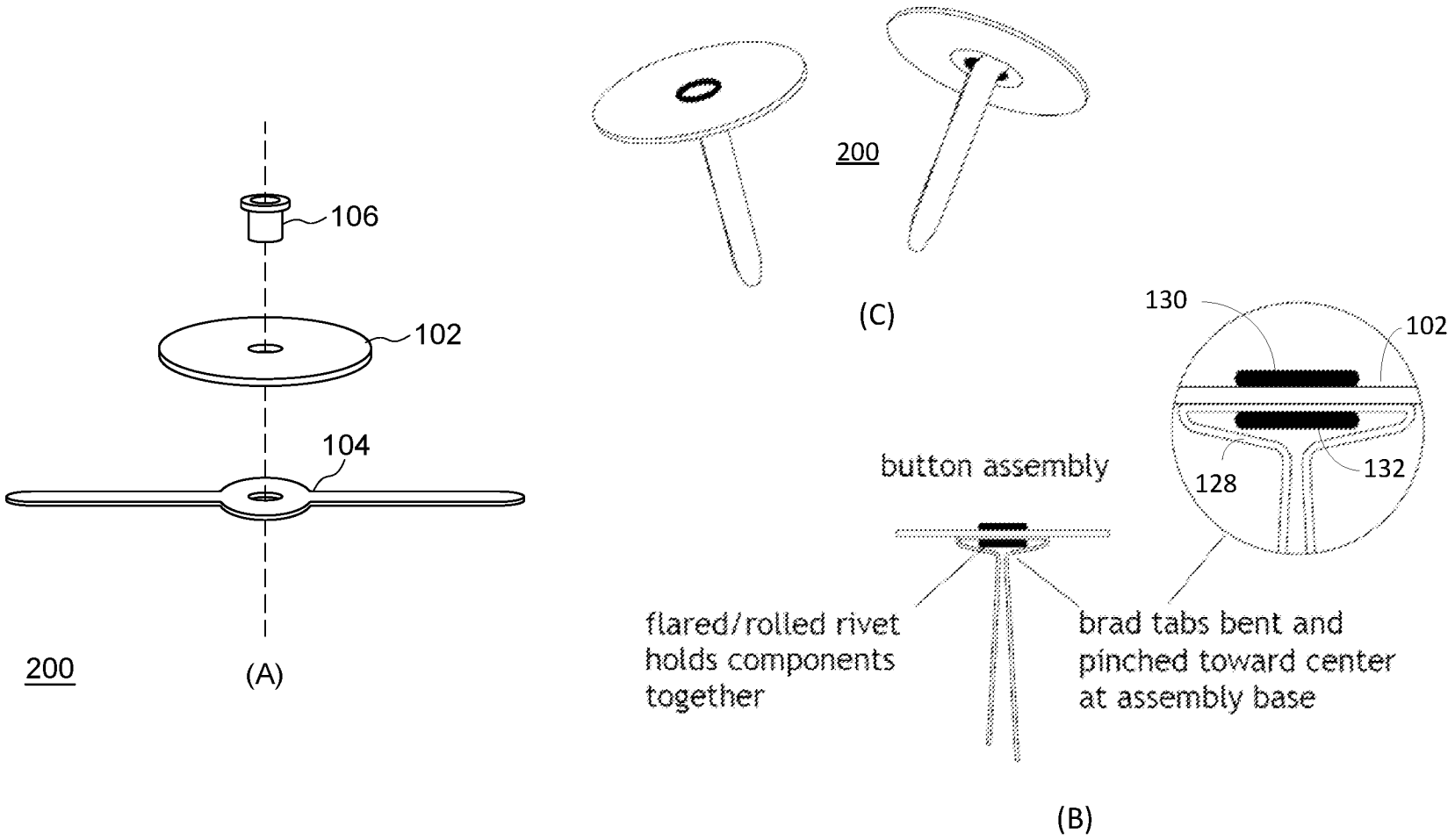
FIGS. 2A-2C illustrate forming of a button assembly for a fastening system.

FIGS. 2A-2C illustrate forming of a button assembly 200, each of which includes one button 102, one rivet 106, and one brad 104. As shown in FIG. 2A, the brad 106 placed under the bottom surface of the button 102, and the rivet 106 is threaded through the central apertures or holes of each until the rivet head abuts the top surface of the button 102. As shown in FIG. 2B, once the pin of the rivet 106 is fully through the central apertures or holes of the button 102 and the brad 106, the pin can be flared or rolled to extend beyond the diameter of the central aperture of the brad 106 to lock the rivet 106 in place with the head of the rivet 106 abutting the top surface of the button 102. FIG. 2C show top and bottom perspective views of the formed button assembly 200.

Figure 3A:
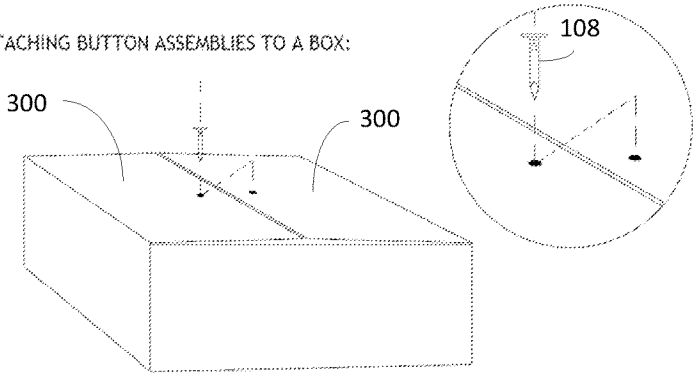
FIGS. 3A-3C illustrate a method for attaching button assemblies to a container.
Figure 3B:
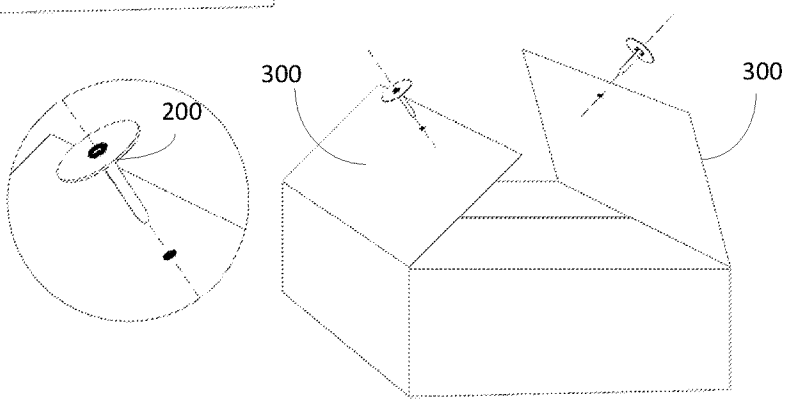
Figure 3C:
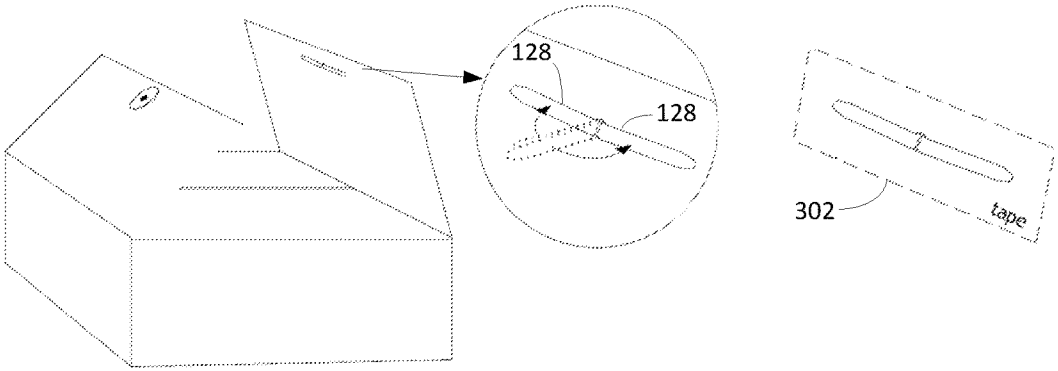

FIGS. 3A-3C illustrate a method for attaching button assemblies to a container, such as a cardboard box having at least two flaps that can enclose a side of the box. As shown in FIG. 3A, the nail 108 is first used to puncture each of the two flaps and form a hole that corresponds with the diameter of the shank of the nail 108. The hole in each flap 300 is preferably made such that the outer periphery of the button is spaced apart from a forward edge of the flap 300, which faces the forward edge of an opposing flap 300, as can be seen in FIG. 3A. As shown in FIG. 3B, next the button assembly 200, as described above, is positioned within the holes made by the nail 108. The tabs 128 of the brad 104 of the button assembly 200 are inserted into the holes, so that they can be bent away from each other to be flush or abutting the underside of each flap 300, as shown in FIG. 3C. In some implementations, a piece of adhesive 302 such as tape is provided with the kit, or can be used independently to secure the tabs 128 to the underside surface of the flaps 300, thereby further securing the associated button assembly in the hole and to the flap 300.

FIGS. 4A-4D illustrates a method of attaching a string to one button 102 of a button assembly. As shown in FIG. 4A, after attaching the button assembly to a box flap, the string 110 can be positioned under the button 102 between a bottom surface of the button 102 and a top surface of the flap of the box. As shown in FIG. 4B, the string 110 can be wrapped one or more times around itself under the button. In some preferred implementations, one wrap-around is sufficient. As shown in FIG. 4C, a firm tug on a distal end of the string 110, while holding a proximal end of the string 110, will cause the string to slip in further under the button 102 and be wound tightly around a portion of the pin 132 of the rivet that is within the hole in the flap. A combination of friction between the string 110 and the button, as well as between winds of the string 110, will secure the string under and around the button, so that, as shown in FIG. 4D, the string is now able to be wound around a second button so as to secure two button assemblies together, as well as enclose the flaps in which they are attached. Accordingly, without the need for tape or folding the flaps against each other, the flaps can be secured in a closed position, as well as easily opened to open the box without any damage to the flaps.

Figure 5A:
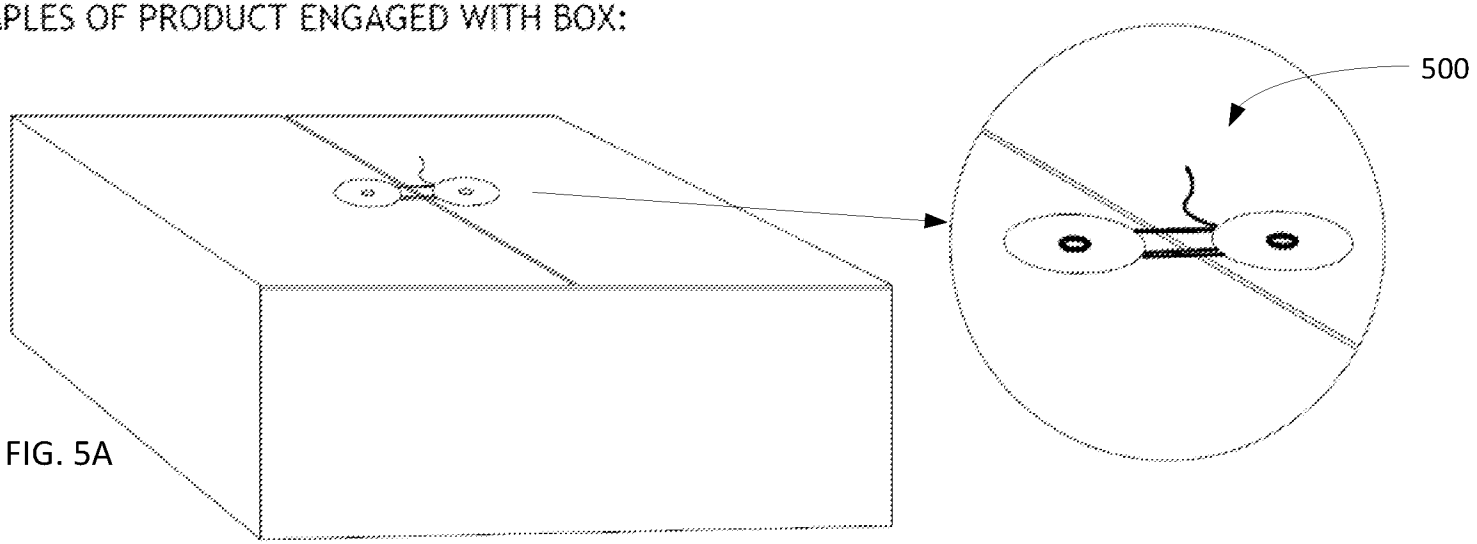
FIGS. 5A-5B illustrate examples of employing one or more fastening systems, in accordance with implementations described herein.
Figure 5B:
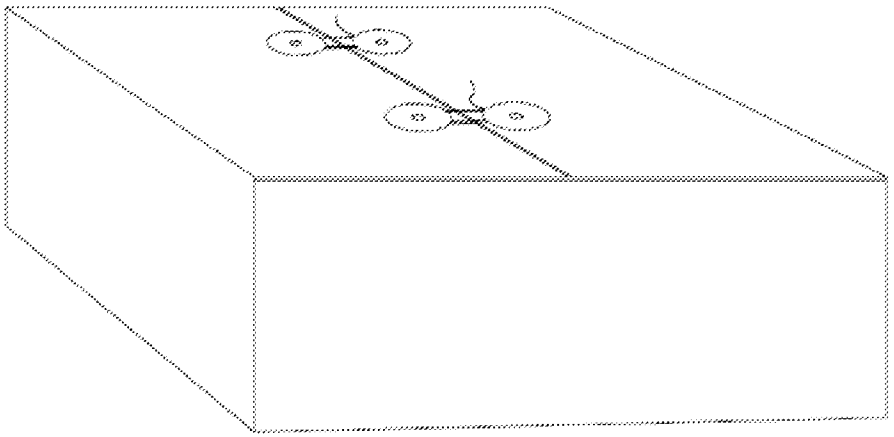

FIGS. 5A and 5B illustrate examples of employing one or more fastening systems 500 to a container such as a box with two flaps that enclose an opening of the box. As shown in FIG. A, a fastening system includes two button assemblies, tied or tethered together by string that is wound underneath a button of each of the button assemblies. One or more fastening systems can be used, as shown in FIG. 5B, which shows two fastening systems comprising four button assemblies and two strings, for fastening opposite ends of the flaps of a box.

Figure 6A:
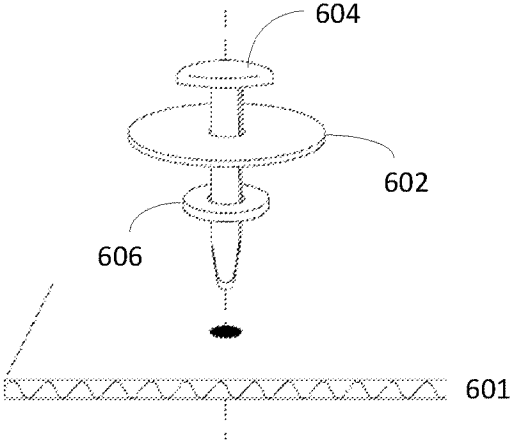
FIGS. 6A-6D show various alternative implementations for attaching a button of a fastening system to a container.

FIGS. 6A-6D show various alternative implementations for attaching a button 602 of a fastening system to a container 601. The button 602 is preferably circular, and having a center hole or aperture. FIG. 6A shows a paper fastening brad 604 with a head and two legs extending downward from the head. The two legs are threaded through the hole or aperture of the button 602, as well as through a spacer washer 606 if needed, such that the head of the paper fastening brad 604 abuts a top surface of the button 602, and the two legs are then in turn threaded through a hole in the container 601, such as in a flap of a box or the like, and then spread out oppositely from each other to secure the paper fastening brad 604 and the button 602 to the container. As described above, a piece of string or twine can be wrapped around the brad under the button 602 and a second button 602 to secure them together.

Figure 6B:
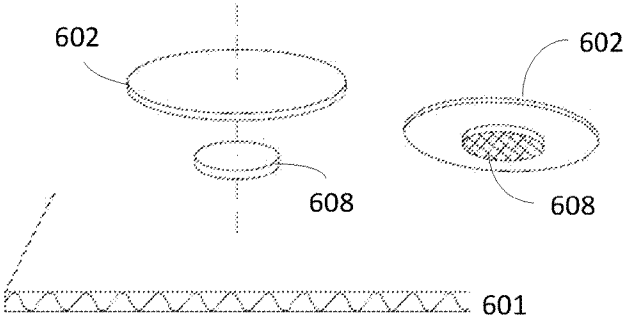

FIG. 6B shows the use of a spacer washer 608 with a pressure-sensitive adhesive applied to both the top and bottom of the spacer washer 608. The adhesive can have a removable protective film. The button 602 in this implementation need not have a central hole or aperture. The spacer washer 608 is adhered to the bottom of the button 602, preferably in concentric alignment. The bottom of the button 602 can include a marking or lines for proper alignment with the spacer washer 608. The opposite side of the spacer washer 608 can then be adhered to a surface of the container 601, such as a flap or the like. The spacer washer 608 can be pre-assembled to the button 602 before use.

Figure 6C:
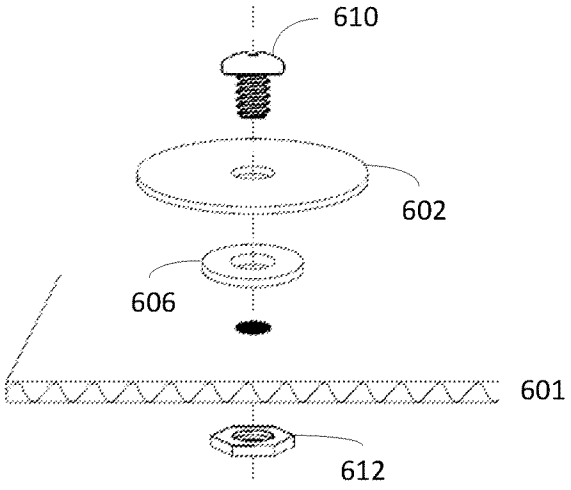

FIG. 6C shows the use of a screw 610 and a nut 612 for securing the button 602 to the container. The screw 610 includes a head, threading extending away from the head, and possibly a shank connected between the head and the threading. The threading is threaded through a hole in the button 602 such that the head of the screw 610 abuts the top surface of the button. As with the implementation shown in FIG. 6A, a spacer washer can be also be used under the button, and threaded by the threading as well. The threading and/or shank are then pushed through a hole in a surface of the container 601, and the nut 612 is screwed onto the threading to secure the screw and secure the button 602 to the container 601. As described above, a piece of string or twine can be wrapped around the brad under the button 602 and a second button 602 to secure them together.

Figure 6D:
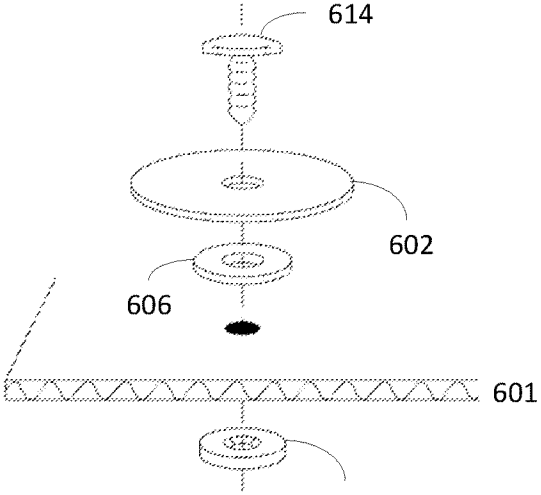

FIG. 6D shows yet another implementation of an attachment mechanism for a fastening system, similar to the structure and operation of the implementation shown in FIG. 6C, but using a plastic snap fastener 614/616 in which a head-bearing protrusion is threaded through the button 602 and possibly the washer 606, if desired, to engage a snap fitting placed on an opposite side of a surface of the container 601 and secure the button 602 to the surface of the container 601.

Although a few embodiments have been described in detail above, other modifications are possible. Other embodiments may be within the scope of the following claims.

The invention claimed is:

1. A fastening system for one or more flaps of a container, the container having an opening that is enclosable by the one or more flaps, the fastening system comprising:

a nail for forming a hole in each of the one or more flaps;

a button assembly configured for insertion into the hole and securement to one of the one or more flaps, the button assembly comprising:

a planar button defined by an outer periphery and having a central aperture;

a brad positioned under the button, and having a ring with a center aperture and at least two tabs extending from a periphery of the ring; and a rivet having a head that abuts a top surface of the planar button and a pin configured for insertion into the central aperture of the planar button and the center aperture of the ring of the brad, the pin being flared after insertion so as to hold the brad together with the planar button;

the at least two tabs of the brad being configured to be spread apart to secure the button assembly to the one of the one or more flaps on a side of the flap opposite the planar button; and a string adapted to be wound under and around the button of the button assembly, and configured to be secured to a second button assembly secured to the container.

2. A fastening kit for one or more flaps of a used container, the used container having an opening that is enclosable by the one or more flaps, the fastening kit comprising:

a button configured for securement to a top surface of each of the one or more flaps of the used container;

an attachment mechanism for securing the button to the top surface of each of the one or more flaps of the used container, wherein the attachment mechanism includes a spacer having a top side and a bottom side, each of the top side and bottom side being applied with a pressure-sensitive adhesive; and a string adapted to be wound under and around the button after securement to the top surface of one of the one or more flaps, and configured to be secured to a second button secured to another one of the one or more flaps.

3. The fastening kit in accordance with claim 2, wherein the attachment mechanism is a brad that is coupled to an underside of the button by a rivet, the brad having a ring with a center aperture occupied by the rivet, and at least two tabs extending from a periphery of the ring, the at least two tabs of the brad being configured to be spread apart to secure the button to the one of the one or more flaps on a side of the flap opposite the button.

4. The fastening kit in accordance with claim 2, wherein the attachment mechanism is a paper fastening brad configured to be threaded through an aperture in the button and a hole in one of the one or more flaps of the container.

* * * * *